US009603215B2

(12) United States Patent
Shin et al.

(10) Patent No.: US 9,603,215 B2
(45) Date of Patent: Mar. 21, 2017

(54) AC LED DRIVING CIRCUIT

(71) Applicant: Merlot Laboratories Inc., Seoul (KR)

(72) Inventors: So-Bong Shin, Seoul (KR); Ok Hwan Kwon, Seoul (KR)

(73) Assignee: MERLOT LABORATORIES INC., Seoul (KR)

( * ) Notice: Subject to any disclaimer, the term of this patent is extended or adjusted under 35 U.S.C. 154(b) by 169 days.

(21) Appl. No.: 14/413,759

(22) PCT Filed: Oct. 28, 2014

(86) PCT No.: PCT/KR2014/010149

§ 371 (c)(1),
(2) Date: Jan. 9, 2015

(87) PCT Pub. No.: WO2015/068978

PCT Pub. Date: May 14, 2015

(65) Prior Publication Data

US 2016/0278177 A1 Sep. 22, 2016

(30) Foreign Application Priority Data

Nov. 5, 2013 (KR) ..... 10-2013-0133449

(51) Int. Cl.
*H05B 33/08* (2006.01)

(52) U.S. Cl.
CPC ..... *H05B 33/0851* (2013.01); *H05B 33/083* (2013.01); *H05B 33/0809* (2013.01)

(58) Field of Classification Search
CPC ..... H05B 33/0851; H05B 33/0809; H05B 33/083
See application file for complete search history.

(56) References Cited

U.S. PATENT DOCUMENTS

2014/0361623 A1* 12/2014 Siessegger ..... H05B 33/0803 307/64
2015/0305098 A1* 10/2015 Jung ..... H05B 33/0824 315/122

FOREIGN PATENT DOCUMENTS

KR 20120094884 A 8/2012
KR 20130091461 A 8/2013

OTHER PUBLICATIONS

ISR dated Jan. 16, 2015 for PCT/KR2014/010149 and English translation.

* cited by examiner

*Primary Examiner* — Douglas W Owens
*Assistant Examiner* — Jonathan Cooper
(74) *Attorney, Agent, or Firm* — Lucas & Mercanti, LLP

(57) ABSTRACT

The present invention relates to an AC LED driving circuit that can greatly improve flicker-free characteristics and implement an excellent power factor. The AC LED driving circuit according to the present invention includes an LED lighting unit connected to an output terminal of a power supply unit, a current channel switching unit connected to an output terminal of the LED lighting unit to form a current supply channel for the LED lighting unit, a voltage charging unit connected in parallel with a connection line between the power supply unit and the LED lighting unit and configured to charge a voltage from the power supply unit, and have a switching function for the LED lighting unit to selectively supply a charged voltage to the LED lighting unit, and a charged voltage switching control unit for controlling a switching function of the voltage charging unit.

16 Claims, 10 Drawing Sheets

(a)

(b)

AC LED DRIVING CIRCUIT

CROSS-REFERENCE TO RELATED APPLICATIONS

This application is a 371 of PCT/KR2014/010149, filed Oct. 28, 2014, which claims the benefit of Korean Patent Application No. 10-2013-0133449, filed Nov. 5, 2013, the contents of each of which are incorporated herein by reference.

TECHNICAL FIELD

The present invention relates generally to an Alternating Current (AC) Light Emitting Diode (LED) driving circuit and, more particularly, to an AC LED driving circuit that can greatly improve flicker-free characteristics and implement an excellent power factor.

BACKGROUND ART

An AC LED driving circuit proposed as a scheme for driving an LED under an AC power condition is advantageous in that a manufacturing process is simple, a defect rate is low, and a lifespan is long, compared to a Switched Mode Power Supply (SMPS) scheme.

Referring to FIG. 1, FIG. 1 is a diagram showing a conventional, typical AC LED driving circuit. Such an AC LED driving circuit has sequential control of current sources as a fundamental principle.

However, such an AC LED driving circuit has great vulnerability from the standpoint of occurrence of flicker due to a fundamental driving scheme in spite of excellent advantages such as high efficiency, long lifespan, and high reliability, and reduction in the size of LED lighting compared to an SMPS-type LED lighting driver. That is, the AC LED driving circuit basically adopts a scheme for sequentially driving current for a varying input voltage, thus making it very difficult to be completely free from LED shading.

Referring to FIG. 2, FIG. 2(*a*) shows an image acquired by capturing a commercial lighting device in which an actual AC LED driving circuit is used. As shown in FIG. 2(*b*), when power is driven at a frequency of 60 Hz, and the periodic turning-on/off operations of LEDs occur at a frequency of 120 Hz. Typically, since a person cannot perceive regular flickering of light occurring at a frequency of 80 Hz or more, there is no problem with the naked eye. However, when a light source, operating as shown in FIG. 2(*b*), is directly captured, regular black stripes appear horizontally or vertically in a picture and a video, as shown in FIG. 2(*a*). A phenomenon in which such a regular black stripe appears is called a stroboscopic effect.

DISCLOSURE

Technical Problem

The present invention has been made keeping in mind the above problems, and an object of the present invention is to provide an AC LED driving circuit that can greatly improve flicker-free characteristics and implement an excellent power factor.

Technical Solution

In order to accomplish the above object, an AC LED driving circuit according to the present invention includes an LED lighting unit connected to an output terminal of a power supply unit, a current channel switching unit connected to an output terminal of the LED lighting unit to form a current supply channel for the LED lighting unit, a voltage charging unit connected in parallel with a connection line between the power supply unit and the LED lighting unit and configured to charge a voltage from the power supply unit, and have a switching function for the LED lighting unit to selectively supply a charged voltage to the LED lighting unit, and a charged voltage switching control unit for controlling a switching function of the voltage charging unit.

Further, when a voltage value supplied by the power supply unit is set to V1, and a voltage value required to normally operate the LED lighting unit and the current channel switching unit is set to VT, the charged voltage switching control unit may switch a switching function of the voltage switching unit to a closed state for the LED lighting unit.

Furthermore, the voltage charging unit may include a charging unit connected to a connection line between the power supply unit and the LED lighting unit, and a switch disposed on a connection line between the charging unit and the LED lighting unit and configured to be opened or closed under the control of the charged voltage switching control unit.

Furthermore, when a voltage value supplied by the power supply unit is set to V1, and a voltage value required to normally operate the LED lighting unit and the current channel switching unit is set to VT, the switch may be opened when V1>VT, may be closed when V1≤VT, and may switch a state thereof to a closed state when V1=VT.

Furthermore, the charging unit may be capacitor and the switch may be a MOS FET.

Furthermore, the charged voltage switching control unit may include a MOS FET connected to a connection node between the switch and the charging unit, a first resistor disposed on a connection line between the connection node between the switch and the charging unit and the MOS FET, an Operational Amplifier (OP AMP) connected at an output terminal thereof to the MOS FET and configured to receive a reference voltage and an output voltage of the MOS FET through input terminals thereof, respectively, and a second resistor connected in common to an output terminal of the MOS FET and to the current channel switching unit.

Furthermore, the current channel switching unit includes an MOS FET connected to an output terminal of the LED lighting unit, and an OP AMP connected at an output terminal thereof to the MOS FET and configured to receive a reference voltage and an output voltage of the MOS FET of the current channel switching unit through input terminals thereof, respectively, and a condition of VREF1<VREF2 is satisfied between the reference voltage (VREF1) applied to the OP AMP of the switching control unit and the reference voltage (VREF2) applied to the OP AMP of the current channel switching unit.

Furthermore, the current channel switching unit may include a MOS FET connected to an output terminal of the LED lighting unit, an OP AMP connected at an output terminal thereof to the MOS FET of the current channel switching unit and configured to receive a reference voltage and an output voltage of the MOS FET of the current channel switching unit through input terminals thereof, respectively, and a third resistor disposed on a connection line between an output terminal of the MOS FET of the current channel switching unit and the second resistor, and wherein a condition of the following equation $$\frac{VREF1}{VREF2} < \frac{R2}{R2 + R3}$$

may be satisfied between a reference voltage (VREF1) applied to the OP AMP of the charged voltage switching control unit, a reference voltage (VREF2) applied to the OP AMP of the current channel switching unit, and resistances of the second resistor and the third resistor.

Furthermore, the charged voltage switching control unit may include a MOS FET connected to a connection node between the switch and the charging unit, a first resistor disposed on a connection line between the MOS FET and the connection node between the switch and the charging unit, an OP AMP connected at an output terminal thereof to the MOS FET and configured to receive a reference voltage and an output voltage of the MOS FET through input terminals thereof, respectively, a second resistor connected in common to an output terminal of the MOS FET and to an output terminal of the current channel switching unit, and a third resistor disposed on a connection line between the second resistor and the output terminal of the MOS FET.

Furthermore, the current channel switching unit includes a MOS FET connected to an output terminal of the LED lighting unit, and an OP AMP connected at an output terminal thereof to the MOS FET of the current channel switching unit and configured to receive a reference voltage, applied in common to an input terminal of the OP AMP of the charged voltage switching control unit, and an output voltage of the MOS FET of the current channel switching unit through input terminals thereof, respectively.

Furthermore, the current channel switching unit may include a MOS FET connected to an output terminal of the LED lighting unit, and an OP AMP connected at an output terminal thereof to the MOS FET of the current channel switching unit and configured to receive a reference voltage and an output voltage of the MOS FET of the current channel switching unit through input terminals thereof, respectively, and a condition of the following equation $$\frac{VREF1}{VREF2} < \frac{R2 + R3}{R2}$$

is satisfied between a reference voltage (VREF1) applied to the OP AMP of the charged voltage switching control unit, a reference voltage (VREF2) applied to the OP AMP of the current channel switching unit, and resistances of the second resistor and the third resistor.

Furthermore, diodes may be respectively disposed on a connection line between the power supply unit and the charging unit, and a connection line between the power supply unit and the LED lighting unit.

Furthermore, the power supply unit may include an AC power source and a rectification circuit for the AC power source.

Furthermore, the LED lighting unit may be configured to include a single LED or a plurality of LEDs connected in series on a connection line between the power supply unit and the current channel switching unit.

Advantageous Effects

In accordance with the present invention, the flicker free characteristics of the AC LED driving circuit may be greatly improved, and an excellent power factor for the AC LED driving circuit may be implemented.

BEST MODE

Hereinafter, an AC LED driving circuit according to an embodiment of the present invention will be described in detail with reference to the attached drawings.

Figure 1:
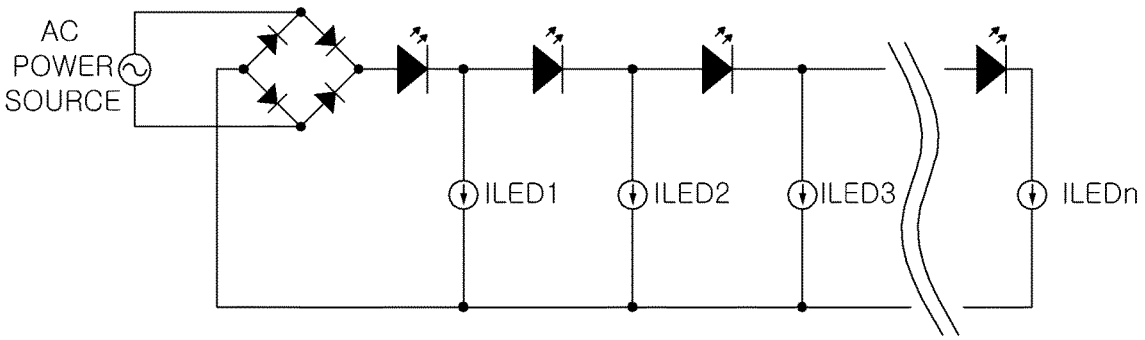
FIG. 1 is a diagram showing a conventional, typical AC LED driving circuit.
Figure 2:
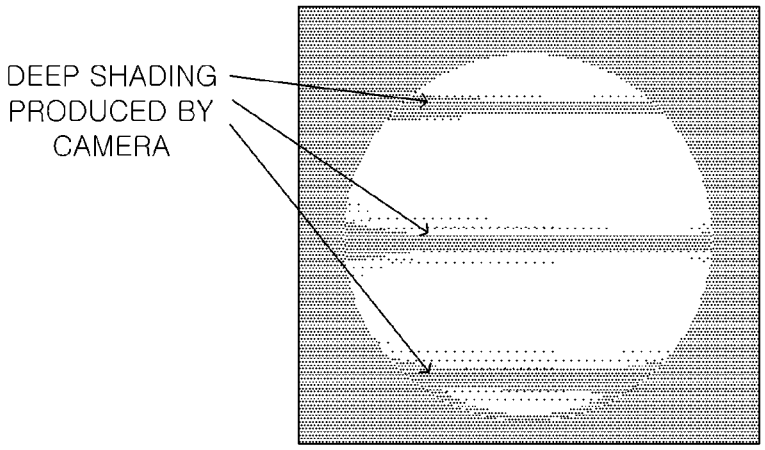
FIGS. 2(*a*) and 2(*b*) are diagrams showing shading appearing at a twice-multiplied AC frequency and a stroboscopic effect occurring in a typical AC LED driving circuit.
Figure 2:
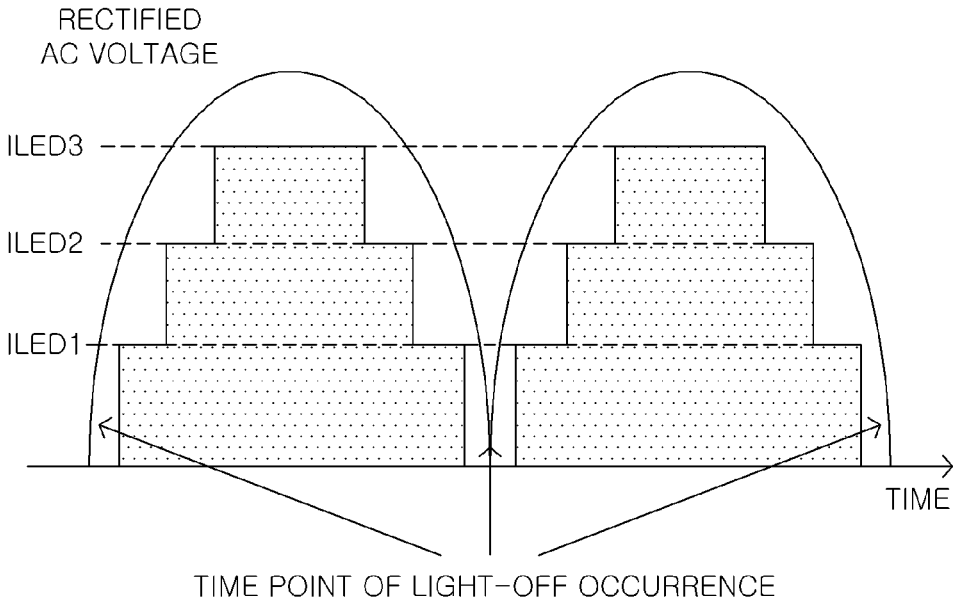
Figure 3:
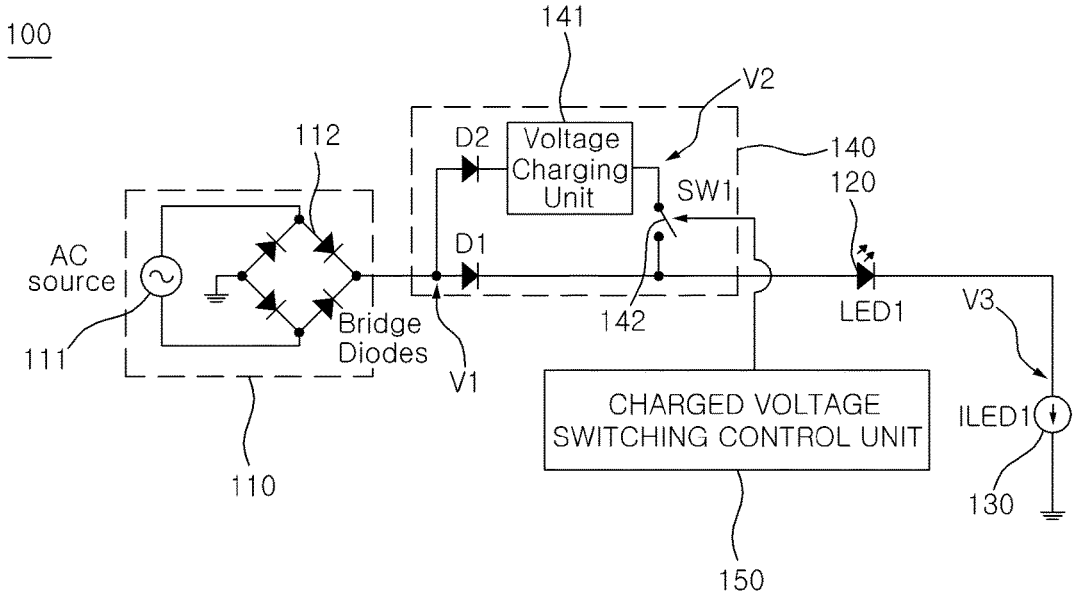
FIG. 3 is a diagram conceptually showing the AC LED driving circuit according to an embodiment of the present invention.

FIG. 3 is a diagram conceptually showing an AC LED driving circuit according to an embodiment of the present invention.

As shown in the drawing, an AC LED driving circuit 100 according to an embodiment of the present invention includes a power supply unit 110, an LED lighting unit 120, a current channel switching unit 130, a voltage charging unit 140, and a charged voltage switching control unit 150.

The power supply unit 110 supplies power to the AC LED driving circuit. In the present embodiment, an example in which the power supply unit 110 includes an AC power source 111 and a rectification circuit 112 for the AC power source 111 has been exemplified, but the power supply unit of the present invention is not limited to such an example.

The LED lighting unit 120, which is connected to the output terminal of the power supply unit 110, may include a single LED or a plurality of LEDs connected in series with each other on a connection line between the power supply unit 110 and the current channel switching unit 130.

The current channel switching unit 130 is connected to the output terminal of the LED lighting unit 120 so as to form a current supply channel for the LED lighting unit 120.

The voltage charging unit 140 is connected in parallel with a connection line between the power supply unit 110 and the LED lighting unit 120. The voltage charging unit 140 is configured to charge voltage from the power supply unit 110, and to have a function of switching the LED lighting unit 120 so that the charged voltage is selectively supplied to the LED lighting unit 120.

The voltage charging unit 140 may include a charging unit 141 and a switch 142. The charging unit 141 is connected to a connection line between the power supply unit 110 and the LED lighting unit 120, and the switch 142 is disposed on a connection line between the charging unit 141 and the LED lighting unit 120 and is opened or closed under the control of the charged voltage switching control unit 150. In the present embodiment, an example in which the charging unit 141 is a capacitor and the switch 142 is a Metal-Oxide Semiconductor FET (MOS FET) has been illustrated, but the present invention is not limited to such an example.

The charged voltage switching control unit 150 controls the switching function of the voltage charging unit 140.

Figure 4:
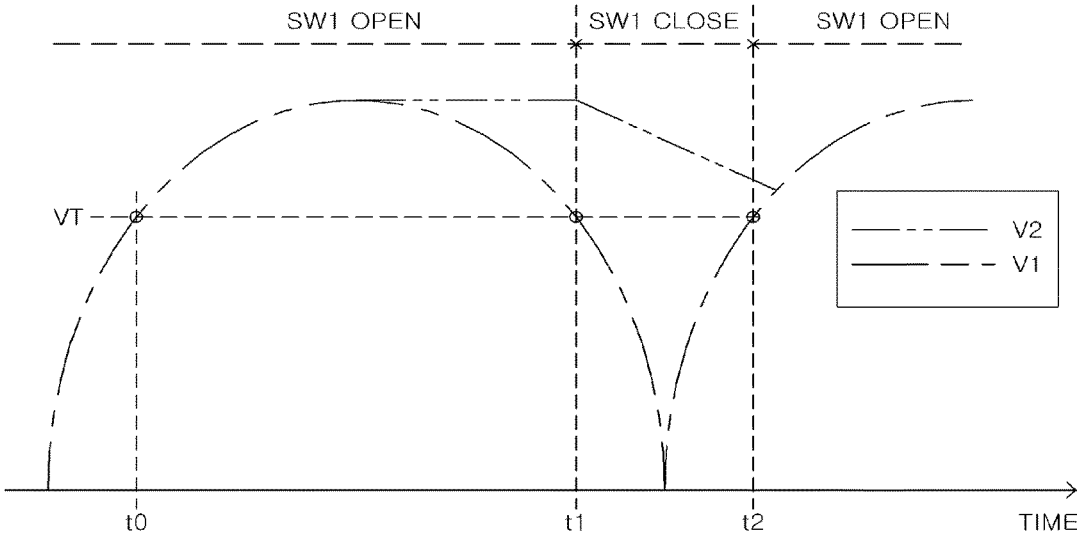
FIG. 4 is a diagram showing the principal voltage waveforms of the AC LED driving circuit according to the embodiment of the present invention.

FIG. 4 is a diagram showing the principle voltage waveforms of the AC LED driving circuit according to the embodiment of the present invention. The operating principle of the AC LED driving circuit according to the embodiment of FIG. 3 will be described.

First, when a supply voltage from the power supply unit 110 is increased, voltages V1 and V2 are simultaneously increased. At this time, since the voltages V1 and V2 are identical to each other, the switch 142 may be in any state of being opened or closed.

Further, the LED lighting unit 120 (LED1) is turned on from time point t0 at which the voltage rises and reaches a voltage value VT required to normally operate the current channel switching unit 130 (ILED1) and the LED lighting unit 120 (LED1).

Further, when the supply voltage passes through a peak point and is then decreased, the voltage V1 is also decreased with the decrease in the supply voltage, but the voltage V2 is held at the voltage of the peak point.

Further, when the voltage V1 is decreased and becomes less than the voltage VT, the charged voltage switching control unit 150 switches the state of the switch 142 of the voltage charging unit 140 to a closed state. That is, when V1>VT, the switch 142 is opened; when V1≤VT, the switch 142 is closed; and when V1=VT, the switch 142 switches its state to the closed state. Accordingly, by the voltage V2 previously charged in the charging unit 141 of the voltage charging unit 140, the voltage required to maintain the normal operations of the current channel switching unit 130 (ILED1) and the LED lighting unit 120 (LED1) is acquired.

That is, if the voltage V2 can be held until the voltage V1 is decreased, passes through a next cycle, and then again reaches the VT, the LED lighting unit 120 (LED1) is operated without being turned off. In this case, the current value of the LED lighting unit 120 (LED1) may either be a fixed value or have a small variation to such an extent that flicker is negligible.

As can be seen from the operating principle of the AC LED driving circuit 100, the AC LED driving circuit 100 enables both the current channel switching unit 130 (ILED1) and the LED lighting unit 120 (LED1) to be operated during the entire cycle, and thus flicker-free characteristics may be easily achieved.

Further, the AC LED driving circuit 100 delays a time point at which the charged voltage of the voltage charging unit 140 is used to a time point at which the current channel switching unit 130 (ILED1) and the LED lighting unit 120 (LED1) require the voltage, rather than time points corresponding to the peak points of the voltages V1 and V2. As a result, the fixed current value is used for a longer time. From the standpoint of the power supply unit 110, the waveform of the current more exactly matches that of the voltage, thus consequently and remarkably improving the power factor.

Figure 5:
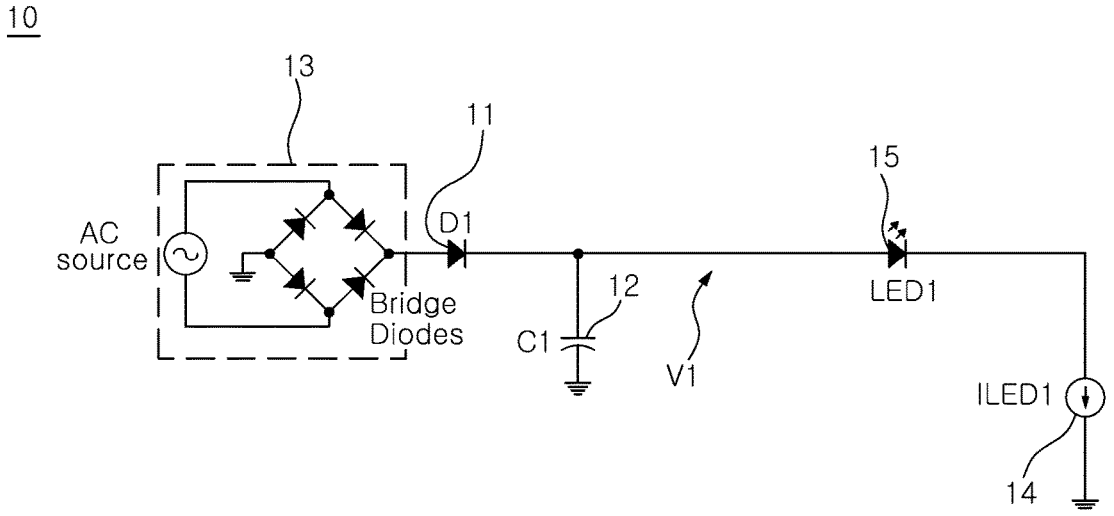
FIG. 5 is a diagram showing another type of AC LED driving circuit to be compared with the AC LED driving circuit according to the embodiment of the present invention.

When an additional description is made with reference to FIG. 5, FIG. 5 is a diagram showing another type of AC LED driving circuit to be compared with the AC LED driving circuit according to the embodiment of the present invention.

As shown in the drawing, an AC LED driving circuit 10 forms a peak-holding circuit for a supply voltage supplied from a power supply unit 13 using a diode 11 and a capacitor 12.

The voltage V1 is intended to track up to the peak value of power and to be held at a voltage value charged in the capacitor in a situation in which AC power is decreased.

In this case, when the size of the capacitor 12 is large enough to hold the voltage required to drive a current source ILED1 14 until the next cycle of the AC power, an LED1 15 will neither be turned on/off nor cause a current variation during the entire cycle, with the result that flicker will never occur.

However, this scheme solves only the flicker, and exhibits the following fatal vulnerabilities.

That is, since the size of the capacitor 12 is excessively large, and the time point at which the capacitor 12 is charged is excessively early, power factor characteristics are very low, and Total Harmonic Distortion (THD) characteristics are also deteriorated. In particular, even if LED lighting is implemented at low power and high efficiency, when the power factor is low, a burden of supply power is placed on a power plant, and thus such a power factor must be improved.

Figure 6:
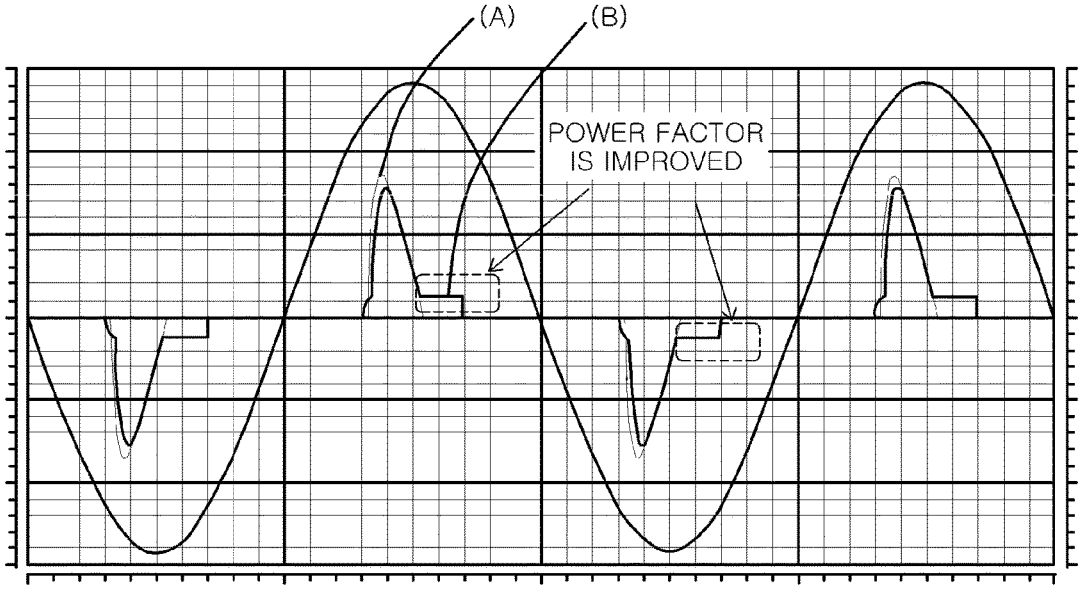
FIG. 6 is a diagram showing the results of computer simulation for obtaining the input current waveforms of the AC LED driving circuit according to the embodiment of the present invention and the AC LED driving circuit of FIG. 5.

In contrast, the AC LED driving circuit 100 according to the embodiment of the present invention perfectly solves the vulnerabilities of the above-described AC LED driving circuit 10 of FIG. 5, and this may be proved with reference to FIG. 6.

FIG. 6 is a diagram showing the results of computer simulation for obtaining the input current waveforms of the AC LED driving circuit according to the embodiment of the present invention and the AC LED driving circuit of FIG. 5.

As shown in the drawing, waveform (A) corresponding to the AC LED driving circuit 10 of FIG. 5 shows that current rapidly rises during a charging period, but is not present in the remaining period other than the charging period. In contrast, waveform (B) corresponding to the AC LED driving circuit 100 according to the embodiment of the present invention shows that a fixed current value is maintained even after passing through the peak point of the supply voltage. This greatly influences the improvement of the power factor from the standpoint of the AC power source.

Below, specific embodiments of the AC LED driving circuit according to the embodiment of the present invention will be described in detail with reference to FIGS. 7 to 9.

Figure 7:
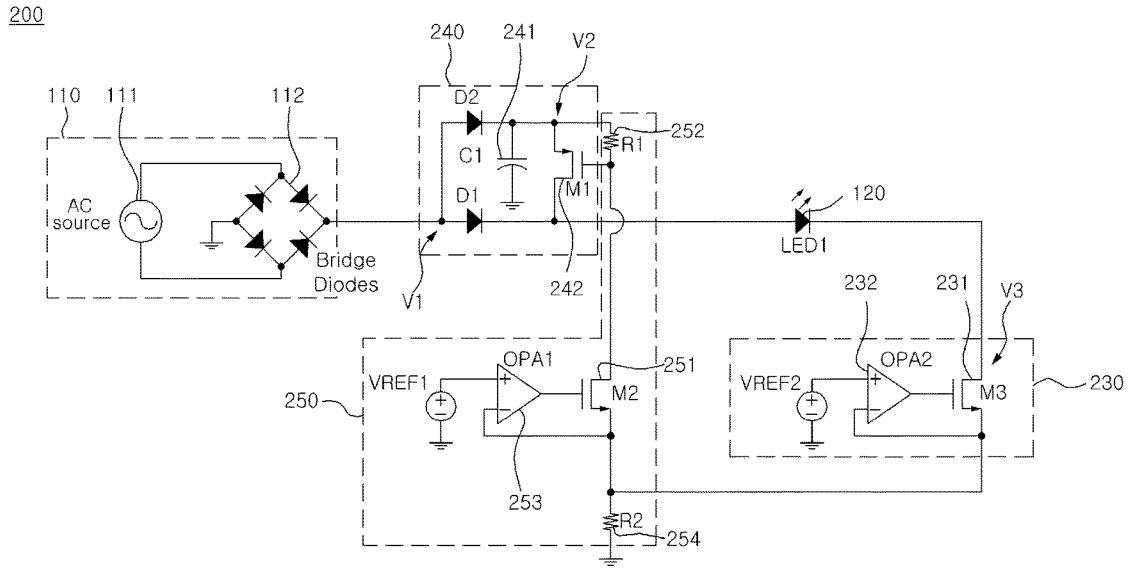
FIGS. 7 to 10 are diagrams showing specific embodiments of the AC LED driving circuit according to the embodiment of the present invention.
Figure 8:
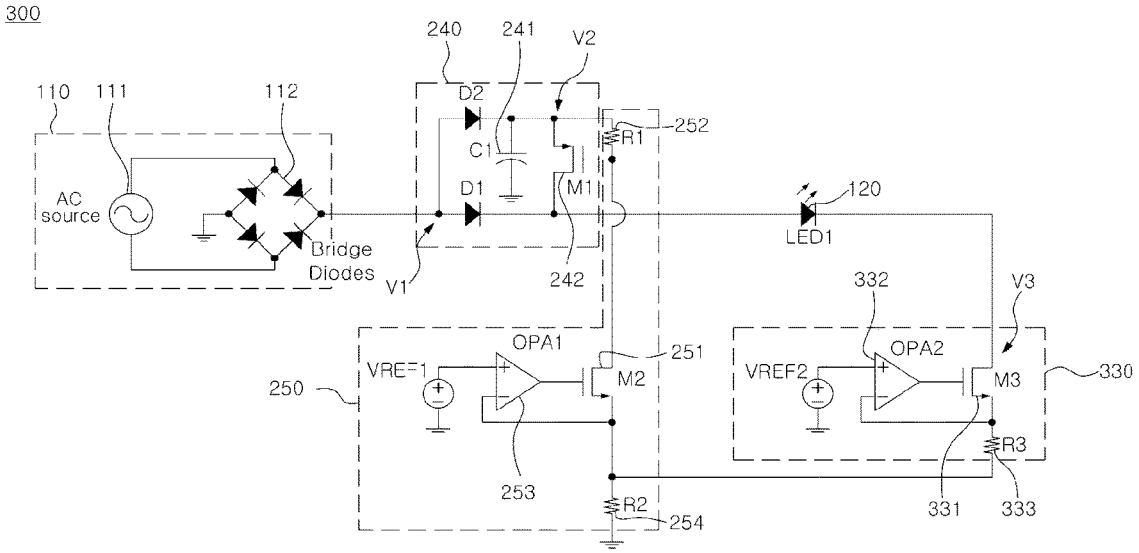
Figure 9:
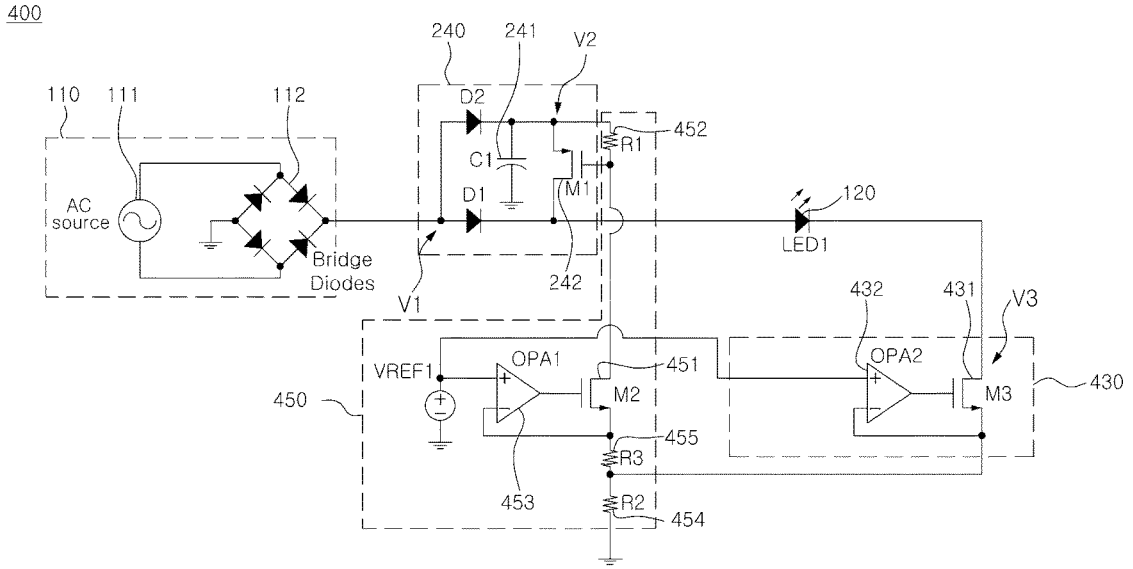

Prior to the description, each of AC LED driving circuits 200, 300, and 400 of FIGS. 7 to 9 basically conforms to the configuration of the AC LED driving circuit 100 according to the embodiment of FIG. 3, and includes a power supply unit 110, an LED lighting unit 120, a current channel switching unit 230, 330, or 430, a voltage charging unit 240, and a charged voltage switching control unit 250 or 450. Further, in the AC LED driving circuits 200, 300, and 400 of FIGS. 7 to 9, the power supply unit 110 and the LED lighting unit 120 have the same configurations as those of the AC LED driving circuit 100 according to the embodiment of FIG. 3. Thus, detailed descriptions thereof are omitted and the same reference numerals are used to designate the same components. A description will be made based on the charged voltage switching control unit 250 or 450, the current channel switching unit 230, 330, or 430, and the voltage charging unit 240.

First, referring to FIG. 7, in the AC LED driving circuit 200, the charged voltage switching control unit 250 includes a second MOS FET 251, a first resistor 252, a first Operational Amplifier (OP AMP) 253, and a second resistor 254.

The second MOS FET 251 is connected to a connection node between the first MOS FET 242 that is the switch of the voltage charging unit 240 and the capacitor 241 that is the charging unit.

The first resistor 252 is disposed on a connection line between the connection node between the first MOS FET 242 and capacitor 241 and the second MOS FET 251.

The first OP AMP 253 is connected at its output terminal to the second MOS FET 251, and is configured to receive a reference voltage and the output voltage of the second MOS FET 251 through its input terminals, respectively.

The second resistor 254 is connected in common to the output terminal of the second MOS FET 251 and to the current channel switching unit 230.

Further, the current channel switching unit 230 includes a third MOS FET 231 connected to the output terminal of the LED lighting unit 120, and a second OP AMP 232 connected at its output terminal to the third MOS FET 231 of the current channel switching unit 230 and configured to receive a reference voltage and the output voltage of the third MOS FET 231 through its input terminals, respectively.

In this case, a condition of VREF1<VREF2 must be satisfied between a reference voltage VREF1 applied to the first OP AMP 253 of the charged voltage switching control unit 250 and a reference voltage VREF2 applied to the second OP AMP 232 of the current channel switching unit 230.

Further, diodes are respectively disposed on a connection line between the power supply unit 110 and the capacitor 241 that is the charging unit and a connection line between the power supply unit 110 and the LED lighting unit 120.

By means of this configuration, the second OP AMP 232 and the third MOS FET 231 of the current channel switching unit 230 form a main current source. Further, when voltage V1 becomes less than voltage VT required to drive the main current source and the LED lighting unit 120 (LED1), a sub-current source composed of the first resistor 252 R1, the first OP AMP 253, the second MOS FET 251, and the second resistor 254 of the charged voltage switching control unit 250 is driven by the charged voltage of the voltage V2. Thus, a difference appears between the source and gate voltages of the third MOS FET 231 of the current channel switching unit 230. Further, when the source-gate voltage difference of the third MOS FET 231 of the current channel switching unit 230 becomes greater than the threshold voltage of the third MOS FET 231, the voltage charged in the capacitor 241 of the voltage charging unit 240 is applied to the LED lighting unit 120 and to the current channel switching unit 230, and then the voltage required for the main current source is supplied.

Further, for this operation, a condition of VREF1<VREF2 must be satisfied between the reference voltage VREF1 applied to the first OP AMP 253 of the charged voltage switching control unit 250 and the reference voltage VREF2 applied to the second OP AMP 232 of the current channel switching unit 230.

Referring to FIG. 8, compared to the AC LED driving circuit 200 according to the embodiment of FIG. 7, the AC LED driving circuit 300 of FIG. 8 is different from the AC LED driving circuit 200 in that the current channel switching unit 330 includes a resistor 333. Therefore, a description will be made based on the current channel switching unit 330 including the third resistor 333. For the remaining components, the corresponding components of the AC LED driving circuit 200 according to the embodiment of FIG. 7 may be referred to, and the same reference numerals are used to designate the same components.

That is, the current channel switching unit 330 includes a third MOS FET 331 connected to the output terminal of the LED lighting unit 120; a second OP AMP 332 connected at its output terminal to the third MOS FET 331 of the current channel switching unit 330, and configured to receive a reference voltage and the output voltage of the third MOS FET 331 through its input terminals, respectively; and the third resistor 333 disposed on a connection line between the output terminal of the third MOS FET 331 of the current channel switching unit 330 and the second resistor 254.

In this case, a condition of $$\frac{VREF1}{VREF2} < \frac{R2}{R2 + R3}$$

must be satisfied between a reference voltage VREF1 applied to the first OP AMP 253 of the charged voltage switching control unit 250, a reference voltage VREF2 applied to the second OP AMP 332 of the current channel switching unit 330, and resistances of the second resistor 254 R2 and the third resistor 333 R3.

Referring to FIG. 9, in the AC LED driving circuit 400, the charged voltage switching control unit 450 includes a second MOS FET 451, a first resistor 452, a first OP AMP 453, a second resistor 454, and a third resistor 455.

The second MOS FET 451 is connected to a connection node between the first MOS FET 242 and the capacitor 241 of the voltage charging unit 240.

The first resistor 452 is disposed on a connection line between the connection node between the first MOS FET 242 and the capacitor 241 and the second MOS FET 451.

The first OP AMP 453 is connected at its output terminal to the second MOS FET 451 and is configured to receive a reference voltage and the output voltage of the second MOS FET 451 through its input terminals, respectively.

The second resistor 454 is connected in common to the output terminal of the second MOS FET 451 and to the output terminal of the current channel switching unit 430.

The third resistor 455 is disposed on a connection line between the second resistor 454 and the output terminal of the second MOS FET 451.

Further, the current channel switching unit 430 is configured to include a third MOS FET 431 connected to the output terminal of the LED lighting unit 120; and a second OP AMP 432 connected at its output terminal to the third MOS FET 431 and configured to receive a reference voltage, applied in common to the input terminal of the first OP AMP 453 of the charged voltage switching control unit 450, and the output voltage of the third MOS FET 431 through its input terminals, respectively.

Furthermore, diodes are respectively disposed on a connection line between the power supply unit 110 and the capacitor 241 that is the charging unit and a connection line between the power supply unit 110 and the LED lighting unit 120.

Figure 10:
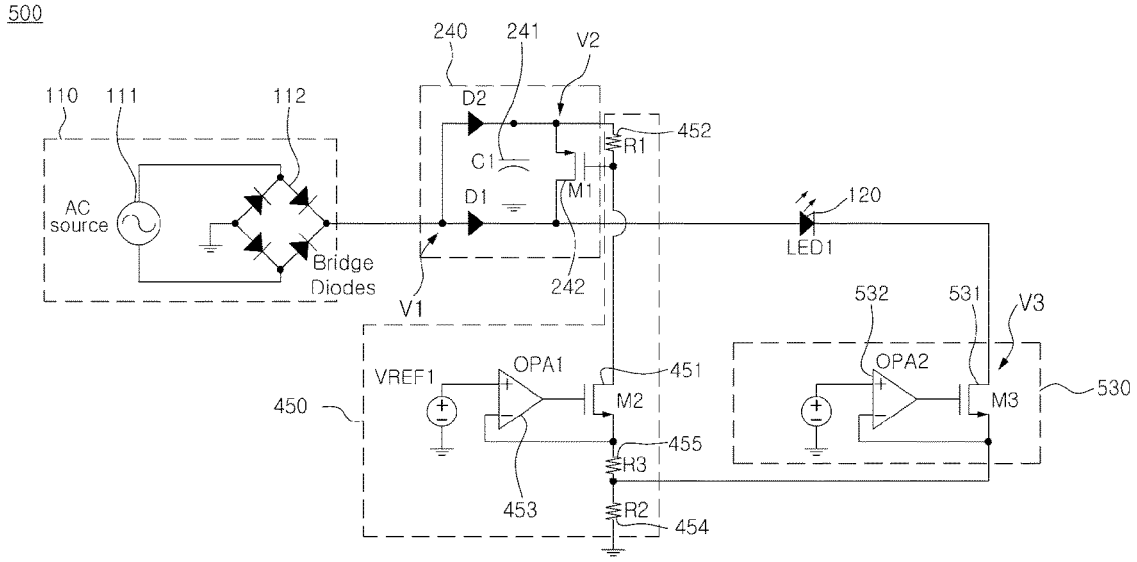

Referring to FIG. 10, compared to the AC LED driving circuit 400 according to the embodiment of FIG. 9, the AC LED driving circuit 500 of FIG. 10 is different from the AC LED driving circuit 400 in that the second OP AMP 532 of the current channel switching unit 530 receives a separate reference voltage through its input terminal. That is, in the AC LED driving circuit 500, the current channel switching unit 530 includes a third MOS FET 531 connected to the output terminal of the LED lighting unit 120; and a second OP AMP 532 connected at its output terminal to the third MOS FET 531 and configured to receive a reference voltage and the output voltage of the third MOS FET 531 through its input terminals, respectively.

Here, a reference voltage VREF1 is applied to the first OP AMP 453 of the charged voltage switching control unit 450 and a reference voltage VREF2 is applied to the second OP AMP 532 of the current channel switching unit 530.

Further, a condition of the following equation $$\frac{VREF1}{VREF2} < \frac{R2 + R3}{R2}$$

must be satisfied between the reference voltage VREF1 applied to the first OP AMP 453 of the charged voltage switching control unit 450, the reference voltage VREF2 applied to the second OP AMP 532 of the current channel switching unit 530, and the resistances of the second resistor 454 R2 and the third resistor 455 R3.

Since the components such as the power supply unit 110, the voltage charging unit 240, and the LED lighting unit 120 of the AC LED driving circuit 500 are the same as those of the AC LED driving circuit 400 of FIG. 9, they will be understood from the AC LED driving circuit 400 of FIG. 9.

As can be seen from the embodiments described with reference to FIGS. 3 to 10, the AC LED driving circuit according to the present invention may greatly improve the flicker-free characteristics of the AC LED driving circuit and may implement an excellent power factor for the AC LED driving circuit.

The above description is merely related to embodiments for practicing the AC LED driving circuit of the present invention, and those skilled in the art to which the present invention pertains will appreciate that the present invention is not limited to the above embodiments, and the technical spirit of the present invention will be present even in a range in which various modifications and changes are possible, without departing from the scope and spirit of the invention as disclosed in the accompanying claims.

INDUSTRIAL APPLICABILITY

The present invention may be widely applied to LED driving circuits.

The invention claimed is:

1. An Alternating Current (AC) Light Emitting Diode (LED) driving circuit, comprising:

an LED lighting unit connected to an output terminal of a power supply unit;

a current channel switching unit connected to an output terminal of the LED lighting unit to form a current supply channel for the LED lighting unit;

a voltage charging unit including a capacitor connected to a connection line between the power supply unit and the LED lighting unit, and a first Metal-Oxide Semiconductor Field Effect Transistor (MOS FET) disposed on a connection line between the capacitor and the LED lighting unit and configured to perform a switching function; and a charged voltage switching control unit including a second MOS FET connected to a connection node between the first MOS FET and the capacitor, a first resistor disposed on a connection line between the connection node between the first MOS FET and the capacitor and the second MOS FET, a first Operational Amplifier (OP AMP) connected at an output terminal thereof to the second MOS FET and configured to receive a reference voltage and an output voltage of the second MOS FET through input terminals thereof, respectively, and a second resistor connected in common to an output terminal of the second MOS FET and to the current channel switching unit, wherein the current channel switching unit includes a third MOS FET connected to an output terminal of the LED lighting unit, and a second OP AMP connected at an output terminal thereof to the third MOS FET and configured to receive a reference voltage and an output voltage of the third MOS FET through input terminals thereof, respectively, wherein a condition of (VREF1)<(VREF2) is satisfied between the reference voltage (VREF1) applied to the first OP AMP of the charged voltage switching control unit and the reference voltage (VREF2) applied to the second OP AMP of the current channel switching unit, and wherein when a voltage value supplied by the power supply unit is set to (V1), and a voltage value required to normally operate the LED lighting unit and the current channel switching unit is set to (VT), the first MOS FET is opened when (V1)>(VT), is closed when (V1)<(VT), and switches a state thereof to a closed state when (V1)=(VT).

2. An AC LED driving circuit, comprising:

an LED lighting unit connected to an output terminal of a power supply unit;

a current channel switching unit connected to an output terminal of the LED lighting unit to form a current supply channel for the LED lighting unit;

a voltage charging unit including a capacitor connected to a connection line between the power supply unit and the LED lighting unit, and a first Metal-Oxide Semiconductor Field Effect Transistor (MOS FET) disposed on a connection line between the capacitor and the LED lighting unit and configured to perform a switching function; and a charged voltage switching control unit including a second MOS FET connected to a connection node between the first MOS FET and the capacitor, a first resistor disposed on a connection line between the connection node between the first MOS FET and the capacitor and the second MOS FET, a first Operational Amplifier (OP AMP) connected at an output terminal thereof to the second MOS FET and configured to receive a reference voltage and an output voltage of the second MOS FET through input terminals thereof, respectively, and a second resistor connected in common to an output terminal of the second MOS FET and to the current channel switching unit, wherein the current channel switching unit includes a third MOS FET connected to an output terminal of the LED lighting unit, a second OP AMP connected at an output terminal thereof to the third MOS FET and configured to receive a reference voltage and an output voltage of the third MOS FET through input terminals thereof, respectively, and a third resistor disposed on a connection line between an output terminal of the third MOS FET and the second resistor of the charged voltage switching control unit, and wherein a condition of the following equation $$\frac{(VREF1)}{(VREF2)} < \frac{(R2)}{(R2)+(R3)}$$

VREF1<R2 is satisfied between a reference voltage (VREF1) applied to the first OP AMP of the charged voltage switching control unit, a reference voltage (VREF2) applied to the second OP AMP of the current channel switching unit, and resistances of the second resistor and the third resistor.

3. An AC LED driving circuit, comprising:

an LED lighting unit connected to an output terminal of a power supply unit;

a current channel switching unit connected to an output terminal of the LED lighting unit to form a current supply channel for the LED lighting unit;

a voltage charging unit including a capacitor connected to a connection line between the power supply unit and the LED lighting unit, and a first Metal-Oxide Semiconductor Field Effect Transistor (MOS FET) disposed on a connection line between the capacitor and the LED lighting unit and configured to perform a switching function; and a charged voltage switching control unit including a second MOS FET connected to a connection node between the first MOS FET and the capacitor, a first resistor disposed on a connection line between the second MOS FET and the connection node between the first MOS FET and the capacitor, a first OP AMP connected at an output terminal thereof to the second MOS FET and configured to receive a reference voltage and an output voltage of the second MOS FET through input terminals thereof, respectively, a second resistor connected in common to an output terminal of the second MOS FET and to an output terminal of the current channel switching unit, and a third resistor disposed on a connection line between the second resistor and the output terminal of the second MOS FET, wherein the current channel switching unit includes a third MOS FET connected to an output terminal of the LED lighting unit, and a second OP AMP connected at an output terminal thereof to the third MOS FET and configured to receive a reference voltage and an output voltage of the third MOS FET through input terminals thereof, respectively, and wherein a condition of the following equation $$\frac{(VREF1)}{(VREF2)} < \frac{(R2)+(R3)}{(R2)}$$

VREF2<R2 is satisfied between a reference voltage (VREF1) applied to the first OP AMP of the charged voltage switching control unit, a reference voltage (VREF2) applied to the second OP AMP of the current channel switching unit, and resistances of the second resistor and the third resistor.

4. An AC LED driving circuit, comprising:

an LED lighting unit connected to an output terminal of a power supply unit;

a current channel switching unit connected to an output terminal of the LED lighting unit to form a current supply channel for the LED lighting unit;

a voltage charging unit including a capacitor connected to a connection line between the power supply unit and the LED lighting unit, and a first Metal-Oxide Semiconductor Field Effect Transistor (MOS FET) disposed on a connection line between the capacitor and the LED lighting unit and configured to perform a switching function; and a charged voltage switching control unit including a second MOS FET connected to a connection node between the first MOS FET and the capacitor, a first resistor disposed on a connection line between the second MOS FET and the connection node between the first MOS FET and the capacitor, a first OP AMP connected at an output terminal thereof to the second MOS FET and configured to receive a reference voltage and an output voltage of the second MOS FET through input terminals thereof, respectively, a second resistor connected in common to an output terminal of the second MOS FET and to an output terminal of the current channel switching unit, and a third resistor disposed on a connection line between the second resistor and the output terminal of the second MOS FET, wherein the current channel switching unit includes a third MOS FET connected to an output terminal of the LED lighting unit, and a second OP AMP connected at an output terminal thereof to the third MOS FET and configured to receive a reference voltage, applied in common to an input terminal of the first OP AMP of the charged voltage switching control unit, and an output voltage of the third MOS FET through input terminals thereof, respectively.

5. The AC LED driving circuit of claim 1, further comprising diodes respectively disposed on a connection line between the power supply unit and the charging unit, and a connection line between the power supply unit and the LED lighting unit.

6. The AC LED driving circuit of claim 1, wherein the power supply unit includes an AC power source and a rectification circuit for the AC power source.

7. The AC LED driving circuit of claim 1, wherein LED lighting unit is configured to include a single LED or a plurality of LEDs connected in series on a connection line between the power supply unit and the current channel switching unit.

8. The AC LED driving circuit of claim 2, further comprising diodes respectively disposed on a connection line between the power supply unit and the charging unit, and a connection line between the power supply unit and the LED lighting unit.

9. The AC LED driving circuit of claim 2, wherein the power supply unit includes an AC power source and a rectification circuit for the AC power source.

10. The AC LED driving circuit of claim 2, wherein LED lighting unit is configured to include a single LED or a plurality of LEDs connected in series on a connection line between the power supply unit and the current channel switching unit.

11. The AC LED driving circuit of claim 3, further comprising diodes respectively disposed on a connection line between the power supply unit and the charging unit, and a connection line between the power supply unit and the LED lighting unit.

12. The AC LED driving circuit of claim 3, wherein the power supply unit includes an AC power source and a rectification circuit for the AC power source.

13. The AC LED driving circuit of claim 3, wherein LED lighting unit is configured to include a single LED or a plurality of LEDs connected in series on a connection line between the power supply unit and the current channel switching unit.

14. The AC LED driving circuit of claim 4, further comprising diodes respectively disposed on a connection line between the power supply unit and the charging unit, and a connection line between the power supply unit and the LED lighting unit.

15. The AC LED driving circuit of claim 4, wherein the power supply unit includes an AC power source and a rectification circuit for the AC power source.

16. The AC LED driving circuit of claim 4, wherein LED lighting unit is configured to include a single LED or a plurality of LEDs connected in series on a connection line between the power supply unit and the current channel switching unit.

* * * * *